US005387736A

United States Patent [19]

Salomone et al.

[11] Patent Number: 5,387,736

[45] Date of Patent: Feb. 7, 1995

[54] PORTABLE DECONTAMINATION SYSTEM AND METHOD FOR ENVIRONMENTAL WELL DRILLING RIGS

[75] Inventors: Joseph Salomone, Vernon; Paul Salomone, Jr., West Paterson, both of N.J.

[73] Assignee: Salomone Bros., Inc., Wayne, N.J.

[21] Appl. No.: 112,952

[22] Filed: Aug. 30, 1993

[51] Int. Cl.[6] ..... A62D 3/00

[52] U.S. Cl. ..... 588/249; 134/45; 134/123; 405/128

[58] Field of Search ..... 405/128, 129, 258, 303; 588/249, 256; 134/25.1, 42, 45, 123, 102.1; 210/751, 747; 15/52.3, 53.4, 50.1, DIG. 2, 53.2; 175/66, 206; 184/106; 220/573

[56] References Cited

U.S. PATENT DOCUMENTS

| | | | |
|---|---|---|---|
| 1,330,303 | 2/1920 | Cleveland | 220/573 X |
| 1,338,714 | 5/1920 | Wagner | 15/53.4 X |
| 1,694,197 | 12/1928 | Woodling | 220/573 X |
| 4,834,194 | 5/1989 | Manchak | 405/128 X |
| 5,033,489 | 7/1991 | Ferre et al. | 15/DIG. 2 |
| 5,062,500 | 11/1991 | Miller et al. | 184/106 |
| 5,067,530 | 11/1991 | Short | 184/106 X |
| 5,288,334 | 2/1994 | Avril | 134/45 X |

FOREIGN PATENT DOCUMENTS

| | | | |
|---|---|---|---|
| 1921891 | 3/1970 | Germany | 134/45 |
| 1618686 | 1/1991 | U.S.S.R. | 134/45 |

*Primary Examiner*—Dennis L. Taylor
*Attorney, Agent, or Firm*—Anthony F. Cuoco

[57] ABSTRACT

A portable decontamination system including a carriage for carrying an operator and a decontamination unit is moved to the site of a truck mounted environmental well drilling rig. The carriage is displaced along the length of the substantially upright rig via a lift, whereupon the operator remotely operates the decontamination unit for washing the rig. Contaminated wash water resulting from washing the rig is caught in a pan for subsequent disposal, or decontamination and re-use, as the case may be.

8 Claims, 3 Drawing Sheets

PORTABLE DECONTAMINATION SYSTEM AND METHOD FOR ENVIRONMENTAL WELL DRILLING RIGS

BACKGROUND OF THE INVENTION

Environmental well drilling involves exploration of underground tank systems containing fuel oil, gasoline and other regulated chemical products, as well as exploration for the containment, recovery, treatment and disposal of contamination from these and other sources.

Environmental well drilling rigs feature truck mounted carousels having augers, drills and other like equipment supported thereon for drilling in sandy granulated soil, clay and sandstone, and rock. After a drilling operation has been completed, the rig must be properly cleaned to remove residual contamination, i.e. decontaminated, before using the rig for another drilling operation.

Prior to the present invention, the aforementioned cleaning required excavating a pit of a suitable size and lining the pit with a plastic liner. The truck with the contaminated rig mounted thereon was driven to the pit and the rig was washed with water for decontamination purposes. The contaminated wash water was caught in the lined pit and subsequently pumped out of said pit into drums. The drums were thereafter transported to staging areas for appropriate disposition as required by governmental regulations. Difficulty is experienced in completely draining the lined pit and removing the plastic liner therefrom without spreading contamination. Moreover, the excavated pit had to be restored, i.e. refilled, after cleaning the rig as aforenoted.

It is evident from the above that cleaning an environmental well drilling rig to decontaminate the rig has heretofore been a cumbersome and time consuming task with a variety of attendant disadvantages. The present invention provides a portable decontamination system and method associated therewith for the purposes described which overcomes these disadvantages.

SUMMARY OF THE INVENTION

This invention contemplates a portable decontamination system and method for environmental well drilling rigs wherein the rigs are mounted on a truck and are disposed in a substantially upright position for drilling purposes. The system includes a portable platform having disposed thereon a self-contained decontamination unit including a clean water supply, a power generator, hot and cold pressure washers, a pump and such other devices and equipment as may be necessary for cleaning the rig. A pan covered by a grill is mounted on the portable platform so that one end thereof is near the self-contained unit and a portable ramp is disposed adjacent the opposite end of the platform. A hydraulic lift is disposed on the platform between the decontamination unit and the rig and is operable for displacement along the length of the substantially upright rig, whereby the rig may be suitably cleaned by an operator disposed on a platform displaced with the lift. The operator remotely operates the self-contained decontamination unit for cleaning the rig.

In practicing the invention, a truck is backed onto the portable platform via the ramp so that the back portion of the truck which supports the substantially upright drilling rig is supported on the grill over the pan. The operator rides in the carriage which is displaced by the hydraulic lift longitudinally from one end of the drilling rig to the other while remotely controlling the self-contained decontamination unit to wash the rig, as is required. The contaminated wash water resulting from washing the rig spills into the pan through the grill. Thereafter, the water in the pan is pumped via the operator-operated pump in the self-contained unit into drums which are then transported to staging areas. Alternatively, the system can be adapted such as with oil water separator—carbon treatment apparatus, whereby the water in the pan may be cleaned and reused for washing other rigs with minimal disposal cost. After a rig is cleaned, the portable decontamination unit is moved to another rig site for cleaning the rig thereat.

The invention thus provides a portable decontamination system and method for drilling rigs which is self-contained and transportable and eliminates the cumbersome process of digging a pit and restoring the pit, as has heretofore been required.

DETAILED DESCRIPTION OF THE INVENTION

Figure 1:
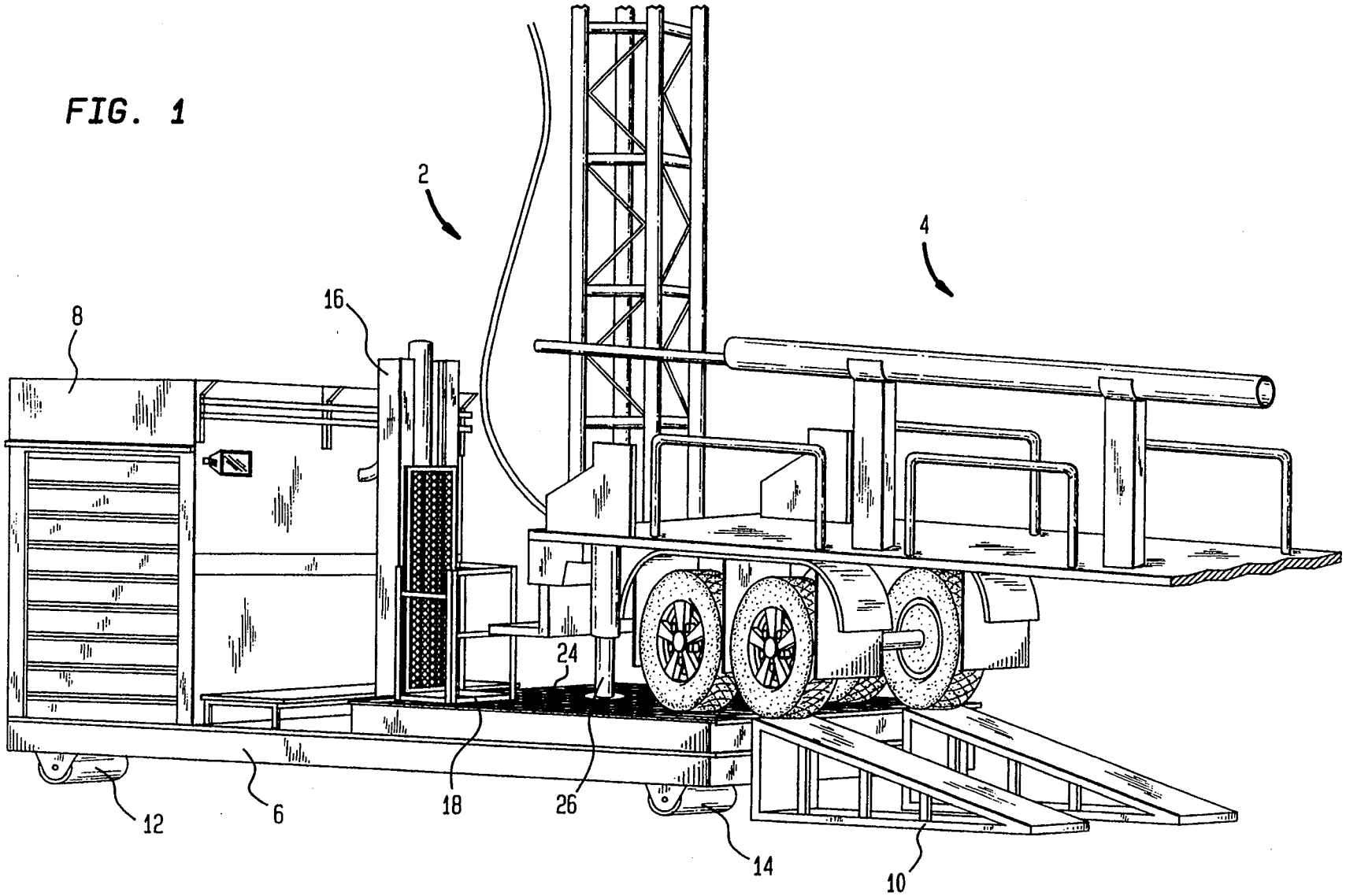
FIG. 1 is a diagrammatic representation generally illustrating the components of the invention.
Figure 3:
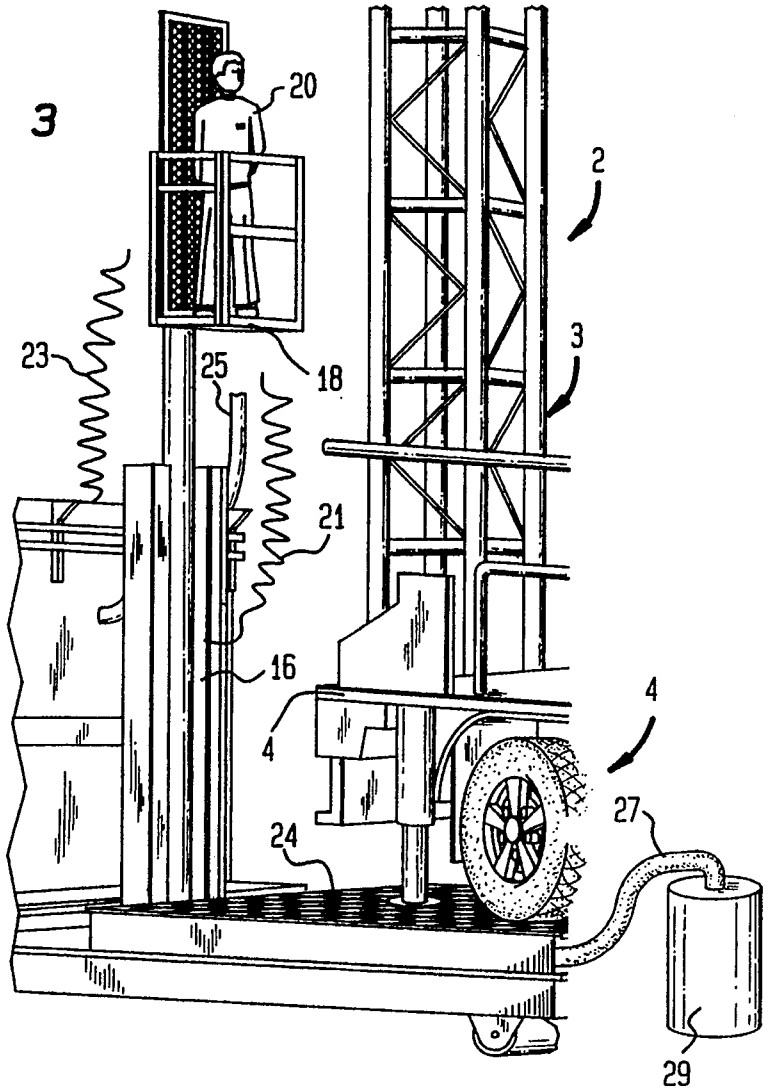
FIG. 3 is a diagrammatic representation particularly illustrating the invention as used.
Figure 2:
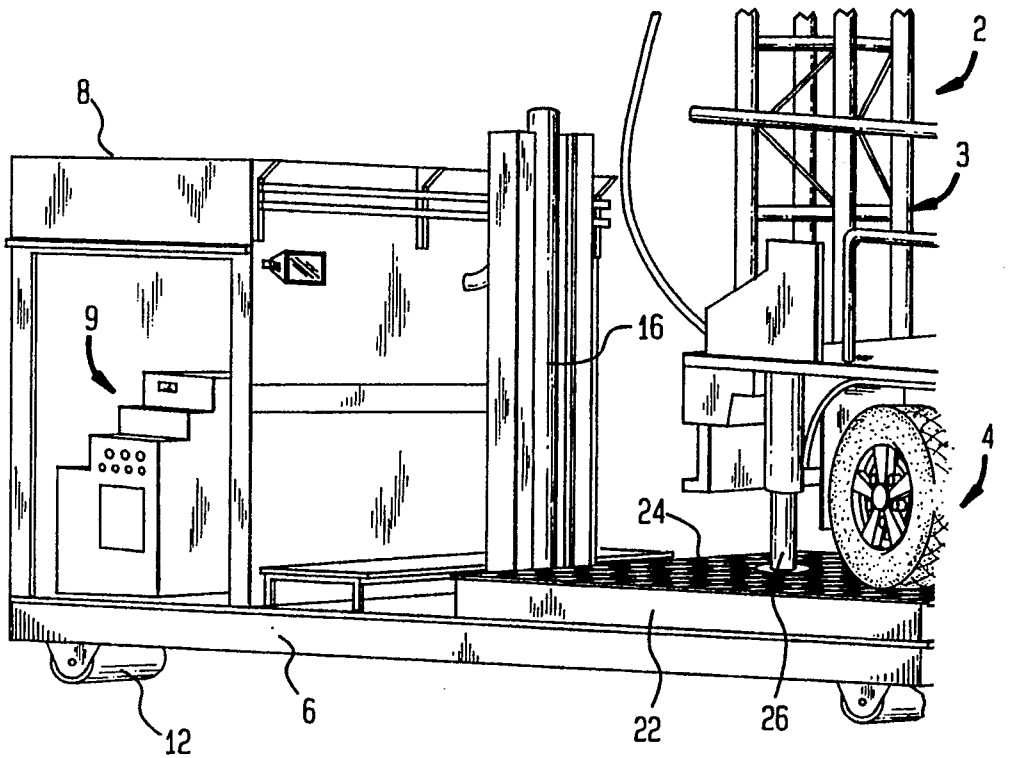
FIG. 2 is a diagrammatic representation particularly illustrating the self-contained unit of the invention.

A drilling rig designated generally by the numeral 2 is supported on the back of a truck 4. Drilling rig 2 includes a carousel or the like 3 containing all of the necessary equipment for drilling in any and all terrains and has the capability to change from high speed drilling augers to basic roller bits, as well as angle drilling devices when conditions warrant sampling under tanks or buildings, as the case may be. Drilling rig 2 is operated from controls on truck 4 (not otherwise shown) for performing the necessary drilling. When transported to a drilling site via truck 4, drilling rig 2 is in a substantially horizontal position on truck 4 and is operator-displaced via truck mounted controls to a substantially upright position, as shown in FIG. 1, 2 and 3 for accomplishing the required drilling. It is to be noted that the particular features of drill rig 2 and truck 4 are not part of the invention and are only described herein to the extent necessary for better understanding said invention.

After a drilling operation has been completed and drill rig 2 must be cleaned, truck 4 is moved to a portable decontamination system in accordance with the invention. Thus, the portable decontamination system includes a platform 6, a self-contained decontamination unit 8 supported at one end of platform 6 and a portable ramp 10 disposed adjacent the opposite end of the platform. Platform 6 is portable and mobile to the extent that it is supported by a pair of rollers such as 12, one on each side of the one end thereof, and a pair of rollers such as 14, one on each side of the opposite end thereof.

A hydraulic lift 16 is supported on portable platform 6 between decontamination unit 8 and drilling rig 2 and carries a carriage 18 for supporting an operator 20 as particularly shown in FIG. 3. Hydraulic lift 16 is remotely operated by operator 20 via a control line 21

(FIG. 3) so that carriage 18 is displaced longitudinally along substantially upright drill rig 2.

Decontamination unit 8 is self-contained with a predetermined quantity of clean water, a power generator, hot and cold pressure washers, and a pump. The various components of unit 8, designated collectively by the numeral 9 in FIG. 2, are remotely operated by operator 20 supported in carriage 18 via a control line 23 (FIG. 3) for cleaning rig 2 via a hose or the like 25 as the carriage is displaced along the rig via hydraulic lift 16.

Platform 6 supports a pan 22 which is covered by a grill 24. The purpose of pan 22 is to catch contaminated wash water resulting from cleaning rig 2. To this extent, truck 4 upon reaching the site of the portable decontamination system of the invention is backed via ramp 10 onto grill 24 of pan 22 and is supported thereon as by stanchions 26.

With truck 4 so disposed, the drill rig is cleaned by operator 20 controlling the several components of unit 8 via control line 23, with the resulting contaminated wash water falling through grill 24 into pan 22. With the arrangement described, all sections of drill rig 2 can be reached for complete cleaning, as is required. When the drill rig has been completely cleaned as aforenoted, truck 2 is driven off of grill 24 via ramp 10. The contaminated wash water in pan 22 is pumped out of the pan via the pump in unit 8 as operated by operator 20 via a suitable hose 27 or the like into, for example, suitable drums such as 29 for subsequent deployment to staging areas, as is required by various governmental regulations. The portable decontamination system including platform 6, unit 8, lift 16 and ramp 10 can then be transported to another site for accomplishing cleaning of another drill rig, as the case may be.

Figure 4:
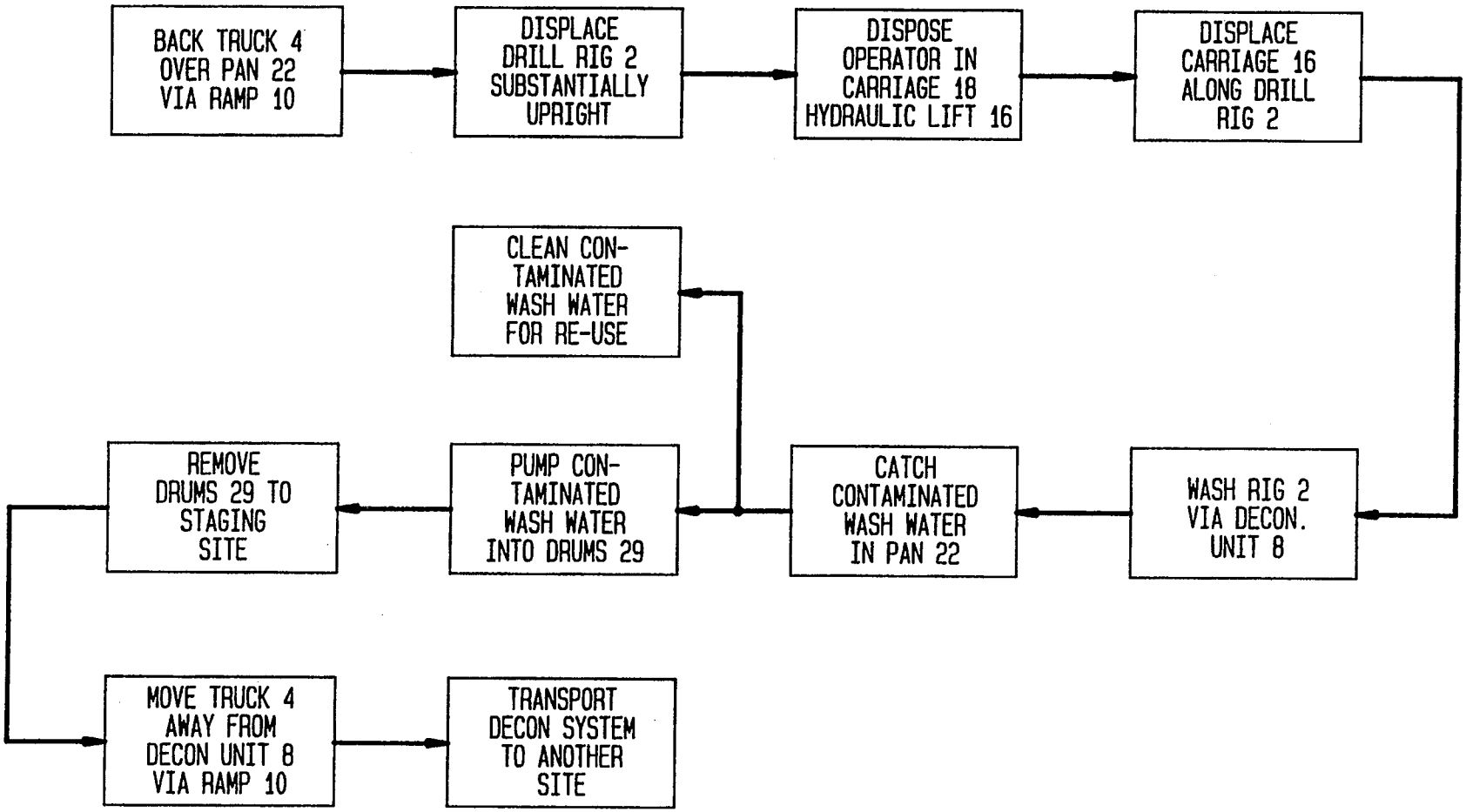
FIG. 4 is a block diagram illustrating the steps of the method of the invention.

The steps of a method for cleaning an environmental drilling rig in accordance with the invention are illustrated in FIG. 4. Thus, truck 4 supporting the rig is backed over grill 24 on pan 22 via ramp 10 and supported on the grill, as heretofore described. Drill rig 2 is displaced so as to be substantially upright. Operator 20 is disposed in carriage 18 on hydraulic lift 16 and the carriage is displaced by the lift longitudinally along substantially upright rig 2.

Rig 2 is washed by an operator via remotely operated self-contained decontamination unit 8, with the contaminated wash water being caught in pan 22 as it flows through grill 24. The contaminated wash water is then pumped into drums such as 29 via the operator-operated pump in decontamination unit 8. In this regard, it will be appreciated that pan 2 may be likewise thoroughly cleaned after the contaminated water from the rig washing operation has been removed therefrom with the resulting wash water from cleaning the pan being likewise pumped into drums such as 29.

Thereafter, the drums are removed to a staging site for transport and/or storage in accordance with governmental regulations. The truck is thereupon moved away from the decontamination unit via the ramp and the decontamination unit lift and ramp are transported to another site for another drill rig washing operation.

Alternatively, the contaminated wash water may be suitably treated as with oil water separator—carbon treatment apparatus so as to remove contaminants therefrom and reused to minimize disposal costs.

It will now be appreciated that cleaning of an environmental drill rig is accomplished without digging a pit or restoration of the pit, as has heretofore been required. The decontamination of the drilling rig is accomplished efficiently, thoroughly and quickly. Additionally, the decontamination unit can be adapted with oil water separator—carbon treatment apparatus, whereby the water can be re-used for washing with minimal disposal cost.

With the above description of the invention in mind, reference is made to the claims appended hereto for a definition of the scope of the invention.

What is claimed is:

1. A portable decontamination system for environmental well drilling rigs of the type which are truck mounted and extend substantially upright from the rear of the truck, comprising:

a portable platform;

a self-contained decontamination unit supported on the platform at one end thereof;

a ramp adjacent the end of the platform opposite the one end;

a lift supported on the platform between the decontamination unit and a drilling rig;

a carriage for supporting an operator, and carried by the lift so as to be displaceable along the length of the substantially upright drilling rig;

a pan supported on the platform between the lift and the ramp;

a grill covering the pan;

the truck being disposed so that the rear thereof is backed via the ramp over the grill;

means for supporting the rear of the truck on the grill;

the lift being remotely operated by the operator supported in the carriage so as to be displaced with the carriage along the length of the rig;

the self-contained decontamination unit being remotely operated by the operator for washing the rig with water contained in said decontamination unit as the carriage is displaced along the length of the rig; and contaminated wash water resulting from washing the rig spilling through the grill into the pan.

2. A system as described by claim 1, wherein:

the platform is supported by rollers on each side of the one end thereof and by rollers on each side of the opposite end thereof so as to be rendered portable.

3. A system as described by claim 1, wherein:

the decontamination unit includes a pump; and the pump is operator-operated for pumping the contaminated wash water from the pan into vessels for subsequent disposal.

4. A method for decontaminating environmental well drilling rigs, comprising:

supporting a pan covered by a grill on a portable platform;

supporting a self-contained decontamination unit on one end of the platform;

disposing a ramp adjacent the end of the platform opposite the one end thereof;

backing a truck supporting an environmental well drilling rig over the ramp so that the back of the truck supporting the rig in a substantially upright position is disposed over the pan and is supported on the grill;

supporting a lift carrying a carriage on the platform between the decontamination unit and the substantially upright rig, said carriage supporting an operator;

the operator remotely operating the lift for displacing the carriage and the operator therewith along the length of the substantially upright rig;

the operator remotely operating the decontamination unit for washing the rig with water contained in said unit as the carriage and the operator are displaced along the length of the rig; and catching contaminated wash water from washing the rig in the pan as said wash water spills through the grill.

5. A method as described by claim 4, including:

rendering the platform portable by disposing a roller on each side of one end of the platform and disposing a roller on each side of the end of the platform opposite the one end.

6. A method as described by claim 4, including:

pumping contaminated wash water out of the pan into vessels and subsequently disposing of said vessels.

7. A method as described by claim 4, including:

moving the truck supporting the decontaminated rig down the ramp away from the platform; and moving the platform supporting the decontamination unit and the lift, and the ramp, to another drilling site for cleaning another rig.

8. A method as described by claim 4, including:

cleaning the contaminated wash water from washing the rig and caught in the pan and subsequently using said cleaned wash water for cleaning another rig.

* * * * *